US008499562B2

(12) United States Patent
Giberson

(10) Patent No.: US 8,499,562 B2
(45) **Date of Patent: *Aug. 6, 2013**

(54) GEARED BOILER FEED PUMP DRIVE

(76) Inventor: Melbourne F. Giberson, Glenmoore, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/251,759

(22) Filed: Oct. 3, 2011

(65) Prior Publication Data

US 2012/0017851 A1 Jan. 26, 2012

Related U.S. Application Data

(63) Continuation of application No. 12/330,310, filed on Dec. 8, 2008, now Pat. No. 8,028,526.

(60) Provisional application No. 60/992,958, filed on Dec. 6, 2007.

(51) Int. Cl.
*F22D 1/00* (2006.01)
*F16H 37/06* (2006.01)

(52) U.S. Cl.
USPC ..... 60/667; 60/670; 74/661; 74/352; 74/732.1

(58) Field of Classification Search
USPC ..... 60/646, 657, 667, 670; 74/661, 352, 74/732.1
See application file for complete search history.

(56) References Cited

U.S. PATENT DOCUMENTS

| | | | | |
|---|---|---|---|---|
| 2,285,431 | A * | 6/1942 | Grossenbacher | 475/77 |
| 2,408,851 | A * | 10/1946 | Hillier et al. | 417/43 |
| 2,802,114 | A | 8/1957 | Artsay | |
| 3,519,883 | A * | 7/1970 | Morey | 361/62 |
| 4,173,124 | A | 11/1979 | Fujii et al. | |
| 5,315,825 | A * | 5/1994 | Giberson | 60/336 |
| 5,331,811 | A | 7/1994 | Giberson | |
| 5,886,505 | A | 3/1999 | Giberson | |
| 7,171,870 | B1 | 2/2007 | Giberson | |
| 8,028,526 | B2 * | 10/2011 | Giberson | 60/646 |

* cited by examiner

*Primary Examiner* — Hoang Nguyen
(74) *Attorney, Agent, or Firm* — Polster, Lieder, Woodruff & Lucchesi, L.C.

(57) ABSTRACT

A geared fluid drive arrangement in which a constant speed motor is used to start a "full-size" boiler feed pump, and is able to operate the pump at a limited speed and correspondingly limited power adequate to fill, pressurize and feed water to a boiler such as would be used for an electrical generating plant to start-up and to operate stably at part load, but not necessarily full load. After the boiler is operating stably, steam from the boiler or from an extraction point of the main turbine is admitted to a mechanical drive steam turbine in order to drive the same "full-size" pump to the normal operating range.

1 Claim, 1 Drawing Sheet

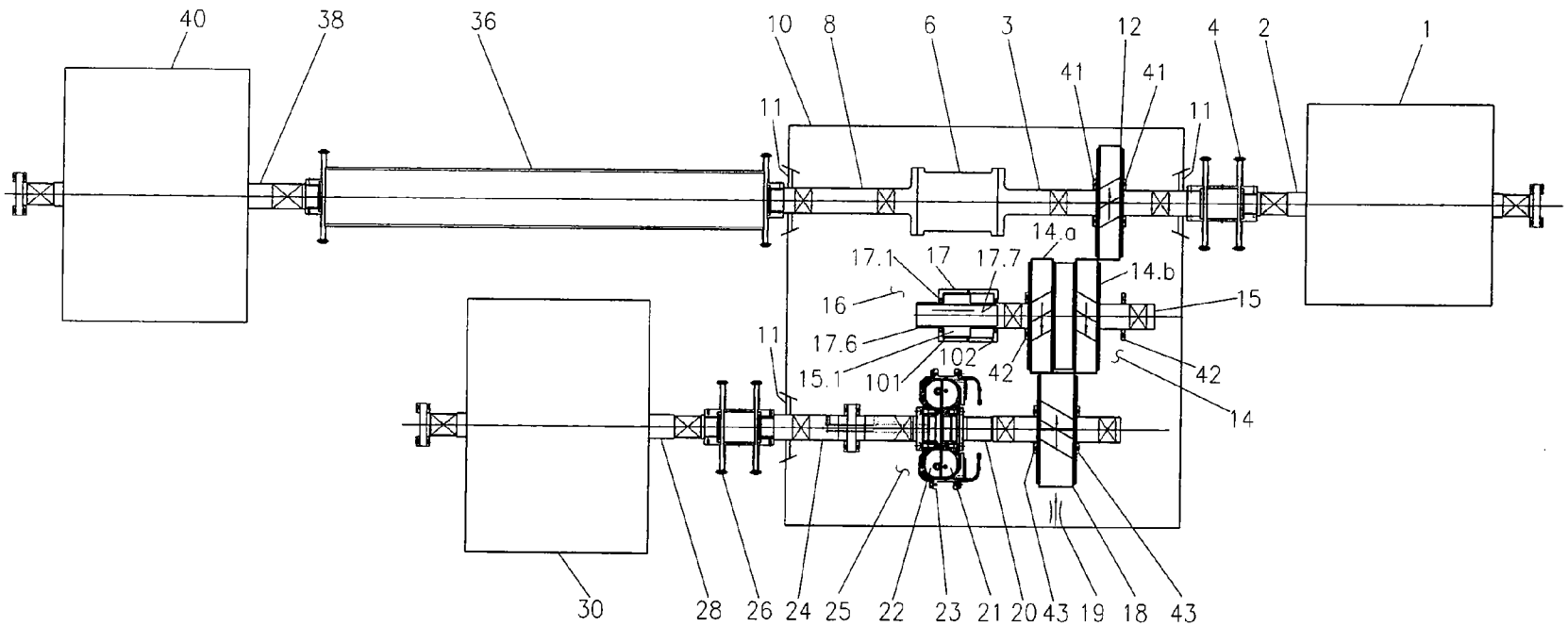
1
2
4
11
12
41
41
3
6
8
10
11
36
38
40
15
14
42
14.b
14.a
17.7
17
17.1
16
17.6
15.1
101
102
42
43
18
19
43
20
21
23
22
25
24
11
26
28
30

GEARED BOILER FEED PUMP DRIVE

CROSS-REFERENCE TO RELATED APPLICATIONS

This application is a continuation of U.S. application Ser. No. 12/330,310, filed Dec. 8, 2008, now U.S. Pat. No. 8,028,526, which claims the benefit of U.S. Provisional Application 60/992,958, filed Dec. 6, 2007, both of which are hereby incorporated herein by reference.

STATEMENT REGARDING FEDERALLY SPONSORED RESEARCH

Not Applicable.

BACKGROUND OF THE INVENTION

High pressure boilers of the type used by electrical generating plants operate at a water pressure generally in the range of 2,000-4,000 psi. Before such a high pressure boiler can be fired up, it must be supplied with water under pressure, for example, on the order of 500 to 1,000 psi, depending upon the boiler design. Water under pressure is supplied by a series of feed pumps, one feeding the other. Initially, the boiler and the series of feed pumps are usually filled with condensate from a condenser using only the condensate pump. In normal operation, the condensate pump usually takes water from a condenser and increases the pressure to about 150 psi and supplies a condensate booster pump which boosts the pressure to approximately 300-600 psi. In turn, the condensate booster pump supplies water to a boiler feed pump which increases the pressure to 1,000 to 4,000 psi depending upon boiler design and the operating condition, such as start-up, part load, or full load.

A very conventional arrangement for boiler feed pumps is to have two boiler feed pumps, one being a start-up pump that is limited in size and driven by a constant speed motor, without a fluid drive, and a second separate main "full-size" pump that is used for normal operation and is driven by a variable speed power source, either (a) a mechanical drive steam turbine, (b) a variable speed fluid drive that is in turn driven by the main turbine-generator, (c) a variable speed fluid drive that is driven by a large constant speed electric motor, or (d) a motor driven by a variable frequency power source based on solid state electronics. When a pump is used for boiler feed pump service and it operates a constant speed, the water flow is controlled by a discharge flow control valve (sometimes called a pressure control valve).

For boiler feed pump service, it is common to use a two-pole motor, and for 60 hz systems, such motors rotate generally at 3600 rpm if it is a synchronous motor, or between 3575 to 3585 rpm if it is an induction motor (3000 rpm for 50 hz systems). Another motor design that is also commonly used is a four-pole motor, and for 60 hz systems, such motors rotate at or near 1800 rpm (1500 rpm for 50 hz systems), but these motors typically use a step-up gear to increase the pump speed to the 3600 rpm range, or higher, depending upon the pump design.

Another conventional arrangement is to have two main pumps "usually approximately 60% capacity each", that are each driven by mechanical drive steam turbines, wherein for start-up, steam from another boiler, either a dedicated start-up boiler, or a boiler of another operating unit, is used to provide steam to drive one or both of these mechanical drive steam turbines during the start-up phase of this unit. In some of these plants where there are two main boiler feed pumps each driven by a mechanical drive steam turbine, a smaller boiler feed pump with discharge flow control valve is driven by a constant speed motor for start-up, for a total of three pumps. The advantage of this arrangement is that the boiler and turbine-generator can be started using electric power either from the grid or from a "black-start" generator, so that no steam source is needed. Clearly, there are advantages to being able to start using a motor driven by a "black-start" generator located at the plant.

BRIEF SUMMARY OF THE INVENTION

An object of the geared differential drive arrangement of this invention is to use one constant speed motor in series with a variable speed fluid drive to start-up a "full-size" boiler feed pump and to operate this pump in a limited speed range requiring corresponding limited power, yet adequate to fill, pressurize, and feed water to a boiler in a controlled manner sufficient for the power plant to reach a stable, part-load condition, but not necessarily a full load condition.

An example where a geared boiler feed pump drive of the arrangement described herein would be advantageous is one where the speed of the "full-size" pump at full load is in the 5500 to 6500 rpm range and the full load power is on the order of 20,000 horsepower to 35,000 horsepower, while for start up and part-load operation, the speed of the same "full-size" pump would be limited to approximately 3500 rpm and the power would be correspondingly lower, generally related to the cube of the speed ratio ($(3500/6500)^3$) which corresponds to the range of 5000 to 7000 horsepower. With the choice of motor speeds (generally 3600 rpm or 1800 rpm for 60 hz systems, or 3000 rpm or 1500 rpm for 50 hz systems) and the ratios of two sets of gears in series, the designer has ample opportunity to establish the rotational speed of the boiler feed pump so that the pump will provide limited but adequate feed water flow and pressure to start-up and to achieve stable part load operation of the boiler feed pump and of the main turbine-generator sufficient to provide adequate main steam from the boiler or adequate extraction steam from the main turbine to drive a mechanical drive steam turbine up to full speed and full power so as to complete the transfer of the source of power driving the boiler feed pump from the motor to the mechanical drive steam turbine, thereby permitting the motor to be shut down.

In an embodiment, after start-up using the motor and variable speed fluid drive to provide power to the "full-size" boiler feed pump, and the boiler has been fired and is operating stably, for example, with the steam from the boiler driving a main turbine-generator, then steam from the boiler or from an extraction point of the main turbine is admitted to a mechanical drive steam turbine for the purpose of driving the boiler feed pump up to the full load operating range, in which case the speed of this mechanical drive steam turbine, the output shaft of which is connected in series to an over-running clutch, is controllably brought up to match the speed of the boiler feed pump as provided by the motor, variable speed fluid drive, and any gear train, at which point the over-running clutch ceases to be over-running. As more steam is admitted to the turbine, the steam turbine picks up more load and when it has taken full load, the boiler feed pump speed will increase and a slidable gear disengages so that the boiler feed pump is driven entirely by the mechanical drive steam turbine.

Advantages associated with the use of a single "full-size" boiler feed pump that can be used for both limited start-up operation as well as for normal "full-size" operation are (a) reduced capital and maintenance expenses for the boiler feed pump, the associated high energy piping, and the control system comprising valves and instrumentation, all parts of which have great economies of scale and are expensive to purchase and to maintain, (b) substantially reduced space requirements for the equipment, and (c) the ability to warm up the main pump slowly during start-up and a very smooth transition to full-load operation.

The equipment of the system of this invention may require an oil conditioning system comprising oil pumps, oil coolers, filters and valving which can be used for lubricating all of the equipment, for supplying all of the circuit oil used by the fluid drive, for supplying high pressure oil to oil jets, or nozzles, that discharge oil at sufficient flow and velocity to be able to turn gears that are associated with the variable speed fluid drive output shaft during the engaging process of a slidable gear, and for supplying high pressure oil to assure that the slidable gear actually fully engages prior to starting the motor and/or to assure that the slidable gear fully disengages once disengagement of the slidable gear is initiated or is desirable.

The fluid drive may be a conventional variable speed fluid drive. The boiler feed pump, motor, over-running clutch, mechanical drive turbine, and oil conditioning system are all conventional pieces of equipment. Conventional over-riding clutches suitable for this application are designed and manufactured by SSS Clutch Company. While the gears of this arrangement use conventional teeth profiles and conventional manufacturing techniques, the gear arrangements are specially adapted for use in this invention.

In accordance with an embodiment of this invention, generally stated, a geared fluid drive arrangement is provided in which a constant speed motor is used to start a "full-size" boiler feed pump, and is able to operate the pump at a limited speed and correspondingly limited power adequate to fill, to pressurize and to feed water to a boiler such as would be used for an electrical generating plant to start-up and to operate stably at part load, but not necessarily full load. After the boiler is operating stably, usually with the steam from the boiler driving a main turbine-generator, then steam from the boiler or from an extraction point of the main turbine is admitted to a mechanical drive steam turbine in order to drive the same "full-size" pump to the normal operating range. In the transfer process from motor drive to turbine drive, the speed of the mechanical drive steam turbine is increased to match the speed of the boiler feed pump at which point an over-running clutch ceases to be over-running, and as more steam is admitted to the mechanical drive steam turbine, this turbine picks up more load, and when it has taken full load, the boiler feed pump speed will increase and the slidable gear would disengage so that the boiler feed pump is now driven entirely by the mechanical drive steam turbine. The motor used for start-up can now be shut down.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification:

FIG. 1 is a somewhat schematic top plan view of a geared fluid drive of this invention.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Referring to FIG. 1, reference number 1 indicates a boiler feed pump operatively connected to a boiler not here shown. The boiler feed pump has a shaft 2 coupled via a flexible coupling 4 to a driven shaft 3 passing through a housing shaft sealing gland 11 in a wall of a housing 10, and connected to an over-riding clutch 6, hence, to an input drive shaft section 8 within housing 10.

Secured to the output shaft 3 is a driven gear 12, located between thrust bearings 41. A slidable gear rotor assembly 14 comprises two separate gears 14.*a* and 14.*b* each secured to a shaft 15, wherein the slidable gear rotor assembly 14 is axially slidable to selectively engage a gear 14.*b* with driven gear 12 and to disengage a gear 14.*b* from driven gear 12, while a gear 14.*a* remains always engaged with the elongated driving gear 18. As shown in FIG. 1, the slidable gear rotor assembly 14 is shown in the disengaged position, that is, as shown, gear 14.*b* is not engaged with driven gear 12. The slidable gear rotor assembly 14 is moved in and out of engagement by a hydraulic shifter 16, with the axial range of sliding motion limited by thrust bearings 42.

The hydraulic shifter 16 comprises an extension of shaft 15 with an enlarged section 15.1 that acts as a dual-acting hydraulic piston within a fixed housing 17 that has three (3) floating ring seals 17.1 to control the leakage of hydraulic oil and to maintain the desired pressure at each end of the piston. To engage slidable gear 14.*b* into driven gear 12, high pressure oil is fed into port 101, and to disengage slidable gear 14.*b* from driven gear 12, high pressure oil is fed through port 102. The extension of shaft 15 through the hydraulic shifter is hollow for two reasons: (a) to reduce the weight so as to control the overhang weight of shaft 15, thereby improving rotor dynamics, and (b) to permit vent holes to be easily located through the circumferential wall of the shaft extension, wherein vent hole 17.6 is used to vent off the hydraulic oil at the end of the engagement stroke, and vent hole 17.7 is used to vent off the hydraulic oil at the end of the disengagement stroke. The purposes of the vent holes are (a) to reduce the pressure of the oil in the selected chamber while the selected shift direction is activated and the shift in the selected direction is complete, and (b) to reestablish the pressure in the selected chamber preventing the shift direction to be reversed should forces on the gear teeth be reversed.

A fluid drive assembly 25 comprises a driving gear 18 that is secured to an output shaft 20 with runner 21 fixedly attached thereto and axially restrained by thrust bearings 43, an impeller 22, and impeller casing 23 which are fixedly attached to an impeller input shaft 24 extending through a suitable shaft housing sealing gland 11 in a wall of housing 10, where it is coupled, through a flexible coupling 26 to an output shaft 28 of a constant speed motor 30.

The input drive shaft section 8 extends through a suitable shaft housing sealing gland 11 of a wall of housing 10 where it is connected to a flex coupling 36, connected in turn to an output shaft 38 of a mechanical drive steam turbine 40.

The fluid drive 25 can illustratively be of a type generally described in U.S. Pat. Nos. 5,331,811, 5,886,505, 5,315,825, or 7,171,870. It requires an oil conditioning system, not here shown, that may have separate oil pumps for lube oil and circuit oil, or may have one oil pump for both lube oil and circuit oil with suitable valving. Depending upon the operating pressures of the lube oil and/or circuit oil pumps, a separate oil pump may be necessary to supply oil to hydraulic jets 19, which serve to rotate the fluid drive driving gear 18 very slowly, for example, on the order of 1 to 5 revolutions per minute, to ensure proper engagement of the slidable gear 14.*b* and the driven gear 12. The motor for the separate oil pump can be fractional horsepower, and the pump can also be small, for example, a gear pump sized to provide oil flow and discharge velocity from the nozzle to rotate gear 18 and slidable gear rotor assembly 14.

In the sequence to put the boiler feed pump into service, assume that the slidable gear rotor assembly 14 is disengaged. Activate the oil conditioning system by starting a pump that supplies lube oil to all of the bearings. A next step is to activate the hydraulic jets 19 to turn the driving gear 18 and, hence, the slidable gear rotor assembly 14 by admitting oil to the jets, or nozzles, 19 either from the lube oil/circuit oil system if the pressure from this pump/these pumps is sufficiently high or from a separate high pressure oil pump, if necessary. After the slidable gear rotor assembly 14 starts to rotate, as detected by instrumentation, not here shown, that detects teeth of gear 18 passing by a suitable sensor, the hydraulic shifter 16 is activated by starting an appropriate high pressure hydraulic pump and admitting high pressure hydraulic oil to the engagement chamber via port 101 so as to shift the slidable gear 14.*b* into engagement with the driven gear 12. Upon full engagement, the hydraulic oil escapes through a vent hole 17.6 in the shaft wall so that there is no hydraulically induced axial force acting on the thrust bearing 42. When instrumentation, not here shown, detects that the slidable gear 14.*b* is fully engaged, a permissive switch is activated so that the motor 30 may now be started.

Another step in the starting sequence is to assure that the scoop tube of the fluid drive, not here shown, is moved to its minimum power transmission position. The scoop tube is used to control the speed of the output shaft and the power transmitted to it, as described amply in the referenced patents on variable speed fluid drives.

After motor 30 is started, it runs at a constant speed, and it turns the input shaft 24 of the fluid drive 25 at the same rotational speed as the motor rotor 28. With the scoop tube in the minimum power position, the fluid drive output shaft 20 rotates slowly, on the order of 500 to 700 rpm, and this causes the slidable gear rotor assembly 14 to rotate along with the output shaft 3, the flexible coupling 4, and the boiler feed pump rotor 2 at rotational speeds determined by the various gear teeth ratios.

The scoop tube of the fluid drive 25 is then operated to increase the rotation of the shaft 20, until the boiler feed pump is running in the speed range desired for start-up, perhaps 1,000 psi. The boiler is then ignited and begins to generate steam, which may be used to drive the main turbine-generator or which may be diverted to the mechanical drive steam turbine 40 to start that turbine. As long as the speed of the turbine shaft 38 is below the boiler feed pump speed as provided by the motor, fluid drive and gear train, generally on the order of 3500 rpm, the over-ridding clutch 6 operates to maintain shaft 8 disengaged from the output shaft 3. When the speed of the steam turbine shaft 38 begins to exceed the speed of the boiler feed pump, generally on the order of 3500 rpm in this example, the over-riding clutch 6 no longer overrides, and the over-riding clutch engages input shaft 8 with output shaft 3, and the steam turbine 40 begins to take over the rotation of the boiler feed pump. At that point, the hydraulic shifter 16 is energized to cause the slidable gear rotor assembly 14 to move to a disengaged condition wherein slidable gear 14.*b* disengages from the driven gear 12.

Various portions of the control logic of the present invention can be embodied in the form of computer-implemented processes and apparatuses for practicing those processes. Control logic for the present invention can also be embodied in the form of computer program code containing instructions embodied in tangible media, such as floppy diskettes, CD-ROMs, hard drives, or an other computer readable storage medium, wherein, when the computer program code is loaded into, and executed by, an electronic device such as a computer, micro-processor or logic circuit, the device becomes an apparatus for practicing the invention.

Control logic for the present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented in a general-purpose microprocessor, the computer program code segments configure the microprocessor to create specific logic circuits.

Numerous variations in the construction and operation of the device of this invention will occur to those skilled in the art in light of the foregoing disclosure. For example, the geared drive device of this invention can be applied to complex operating systems such as driving a compressor string of a refinery wherein partial operation of a substantial portion of the refinery must be achieved before either steam generation equipment or high-pressure hot gas generation equipment can be started and become available to provide the power to a steam turbine or hot gas expander, respectively, that can pick-up the load from the motor, variable speed fluid drive, and slidable gear train of this device, and then drive the compressor string up to full load operating conditions.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

All patents mentioned herein are hereby incorporated by reference.

The invention claimed is:

1. A geared fluid drive to supply boiler feed water to a boiler, comprising;

a constant speed motor connected to drive a fluid drive having an output shaft onto which a drive gear is mounted;

a slidable gear positioned to move between drive gear-engaging position and a neutral position, and, when in drive gear engaging position, engaging a boiler feed pump gear mounted on a boiler feed pump shaft connected to rotate a boiler feed pump, a steam turbine connected to rotate said boiler feed pump shaft, said boiler being operatively connected to supply steam to said steam turbine.

* * * * *